US007322153B2

(12) United States Patent
Nitz et al.

(10) Patent No.: US 7,322,153 B2
(45) Date of Patent: Jan. 29, 2008

(54) BABY GATE

(76) Inventors: Allen S. Nitz, 723 Henry St., Prescott, WI (US) 54021; Carrie Nitz, 723 Henry St., Prescott, WI (US) 54021

( * ) Notice: Subject to any disclaimer, the term of this patent is extended or adjusted under 35 U.S.C. 154(b) by 325 days.

(21) Appl. No.: 10/928,664

(22) Filed: Aug. 27, 2004

(65) Prior Publication Data

US 2006/0042163 A1 Mar. 2, 2006

(51) Int. Cl.
*E05B 3/68* (2006.01)

(52) U.S. Cl. ..... 49/57; 49/394

(58) Field of Classification Search ..... 49/394, 49/395, 399, 55; 16/86.1, 389; 256/73; 292/60, 61, 290, 296, 297, 298; 70/93, 65
See application file for complete search history.

(56) References Cited

U.S. PATENT DOCUMENTS 1,675,033 A * 6/1928 Lefkovitz et al. ..... 292/60
3,670,848 A * 6/1972 Raiguel, Jr. ..... 182/115
4,702,036 A * 10/1987 Johnson ..... 49/55
4,744,392 A * 5/1988 Tade et al. ..... 138/89
4,793,098 A * 12/1988 Wilkerson ..... 49/55
5,060,421 A 10/1991 Castelli
5,360,191 A 11/1994 Carson et al.
5,457,914 A 10/1995 Johnson, Jr.
5,632,514 A 5/1997 Johnson, Jr.
5,860,250 A 1/1999 Hill et al.
5,924,242 A 7/1999 Macari et al.
6,178,694 B1 1/2001 Wagnitz
6,233,874 B1 * 5/2001 Johnson, Jr. ..... 49/465
6,301,832 B1 10/2001 Andersen

* cited by examiner

*Primary Examiner*—Jerry Redman
(74) *Attorney, Agent, or Firm*—Dale J. Ream

(57) ABSTRACT

A gate assembly for selectively opening and closing a passageway includes opposed sides defined by a pair of newel posts. The gate assembly includes a gate, first and second mounting assemblies and a pair of hinges. Each mounting assembly includes a mount face plate, a backing plate and a plurality of fasteners for mounting the face plate to one of the posts. The hinges define a hinge axis and couple the gate to the first mounting assembly face plate and permit pivotal movement of the gate about the hinge axis between first and second open positions and through a closed position through an arc of about 270°. The gate is substantially parallel to the face plate when in the closed position. A caster wheel is coupled with the bottom of the gate in order to facilitate pivotal movement of the gate and to inhibit undesired forces on the hinges.

5 Claims, 14 Drawing Sheets

BABY GATE

BACKGROUND OF THE INVENTION

1. Field of the Invention

The present invention relates to a baby gate for selectively opening and closing a passageway. More particularly, the present invention relates to a novel structure enabling the gate to be set up in passageways previously not compatible with conventional baby gate devices.

2. Discussion of the Prior Art

Many baby gate devices are known in the prior art that may be used to selectively open and close a passageway. A conventional baby gate is disclosed in U.S. Pat. No. 5,360,191 to Carson et al. (the '191 patent). The gate shown in the '191 patent includes a pair of gate panels coupled for longitudinal adjustment in order to permit the gate to fit in passageways of varying widths. The gate of the '191 patent utilizes feet on each of the adjustable panels to be wedged against the sides of the passageway in order to frictionally fit the gate in the passageway for closing the passageway.

Such conventional baby gates operate well when both sides of the passageway are defined by walls, or otherwise present a relatively solid, flat surface for the feet to be wedged against. However, when at least one of the sides of the passageway is defined by a newel post, it is difficult to reliably wedge the feet against the newel post due to its rounded or curved side surface, and the fact that newel posts often become less stable with age allowing deflection of the post. As a result, the post is not suitable for being used as a base against which the feet of a conventional gate may be wedged.

BRIEF SUMMARY OF THE INVENTION

A passageway gate assembly constructed in accordance with the present invention broadly comprises a gate, first and second mounting assemblies and a pair of hinges. The gate assembly is configured to be mounted in a passageway having opposed sides, wherein at least one of the sides is defined by a newel post, for selectively opening and closing the passageway.

Each mounting assembly includes a mount face plate, a backing plate and a plurality of fasteners for mounting the face plate to one of the newel posts. The combination of the face plate, the backing plate and the fasteners clamp the mounting assembly to the newel post to yield a secure base for mounting the gate.

The hinges define a hinge axis and couple the gate to the face plate of the first mounting assembly. The hinges are positioned to permit pivotal movement of the gate about the hinge axis between first and second open positions and through a closed position through an arc of more than 180°. The gate is substantially parallel to the face plate of the first mounting assembly when in the closed position.

A unique latch assembly is provided to latch the gate in the closed position, for selectively and securely closing the passageway. The latch assembly includes a receptacle and a plunger positioned within a plunger housing. The plunger is movable between an extended position for engaging the receptacle, latching the gate, and a retracted position where the plunger disengages the receptacle, unlatching the gate and permitting movement of the gate. The latch assembly also includes a biasing means for biasing the plunger toward the extended position.

In an alternative embodiment, the gate further includes a caster wheel that is coupled with the bottom of the gate in order to facilitate pivotal movement of the gate and partially support the weight of the gate. By partially supporting the gate, the wheel reduces the load placed on the hinges.

Other advantages, benefits and features of the present invention will become apparent to those skilled in the art upon reading the detailed description of the preferred embodiment of the invention as discussed below.

BRIEF DESCRIPTION OF THE SEVERAL VIEWS OF THE DRAWINGS

A preferred embodiment of a baby gate assembly is described in detail below with reference to the drawing figures, wherein.

DETAILED DESCRIPTION OF THE PREFERRED EMBODIMENT

Figure 1:
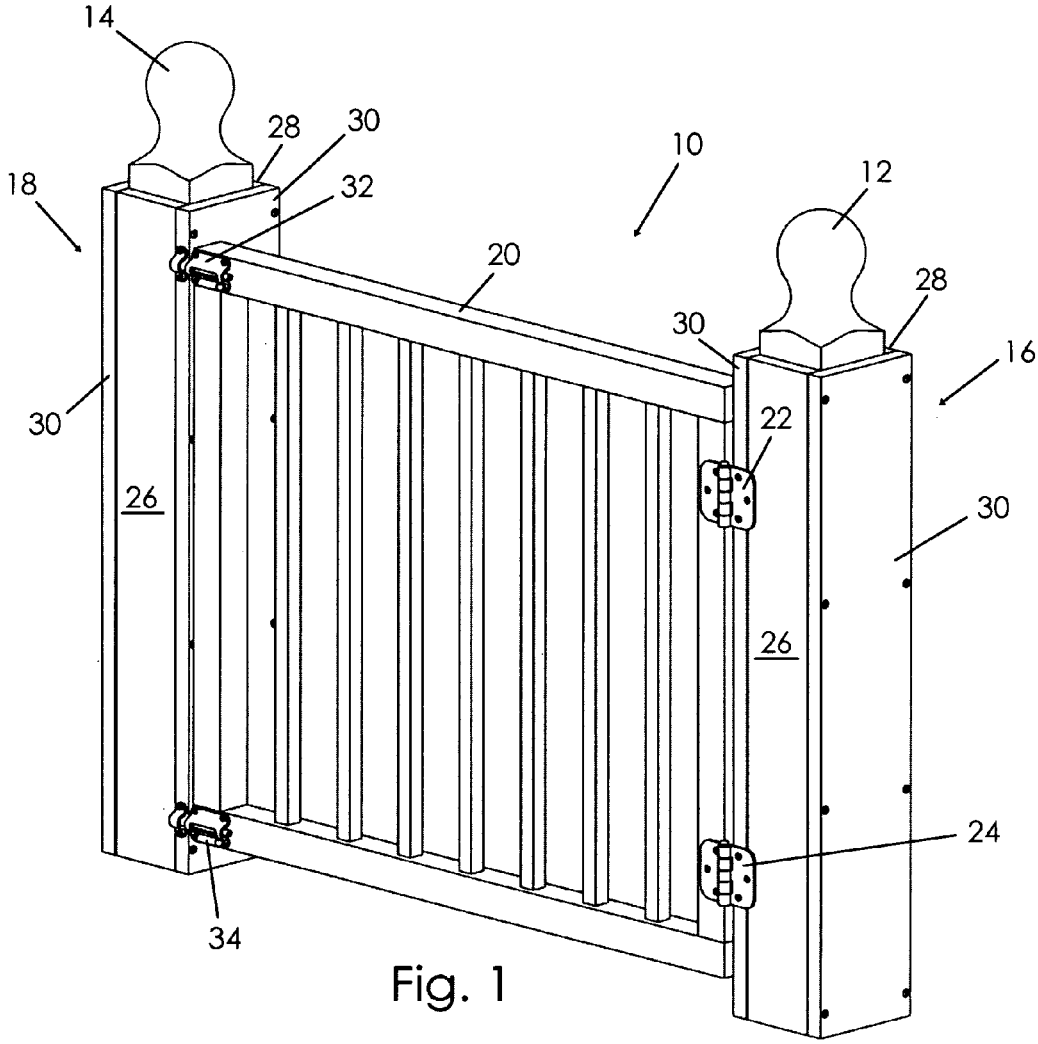
FIG. 1 is a perspective view of the gate assembly constructed in accordance with a first embodiment of the present invention.

Referring now to the drawings, FIG. 1 depicts a passageway gate assembly 10 constructed in accordance with a first embodiment of the present invention. The passageway gate assembly 10 is configured to be mounted in a passageway having opposed sides defined by a pair of newel posts 12, 14 for selectively opening and closing the passageway. Many such passageways exist at the base of or top of a staircase, a particular hazard for youngsters and pets.

The gate assembly 10 broadly includes a pair of mounting assemblies 16, 18, a gate 20 and a pair of hinges 22, 24 coupling the gate 20 to the first mounting assembly 16, and permitting pivotal movement of the gate 20 through an arc of 180° between a first, closed position and a second, open position. Each mounting assembly 16, 18 includes a mount face plate 26, a backing plate 28 and a plurality of fasteners 30 for mounting the face plate to one of the newel posts 12, 14. The combination of the face plate 26, the backing plate 28 and the fasteners 30 clamp each mounting assembly 16, 18 to the respective newel post 12, 14 to yield a secure base for mounting the gate 20.

The hinges 22, 24 define a hinge axis and couple the gate 20 to the face plate 26 of the first mounting assembly 16. The hinges 22, 24 are positioned to permit pivotal movement of the gate 20 about the hinge axis between the open and closed position. The gate 20 is substantially parallel to the face plates 26 of the mounting assemblies 16, 18 when in the closed position. The gate assembly 10 also includes a pair of latches 32, 34 for latching the gate 20 in the closed position to prevent unwanted opening, such as by a youngster.

It will be appreciated that the passageway gate assembly 10 may easily be customized in order to fit passageways of varying widths, such as by altering the width of the gate 20. In addition, the mounting assemblies 16, 18 may be altered in order to attach to newel posts 12, 14 of varying sizes. The gate assembly 10 permits temporary or semi-permanent placement of a gate 20 in a passageway heretofore not compatible with prior art devices, for selectively closing and opening the passageway.

Figure 2A:
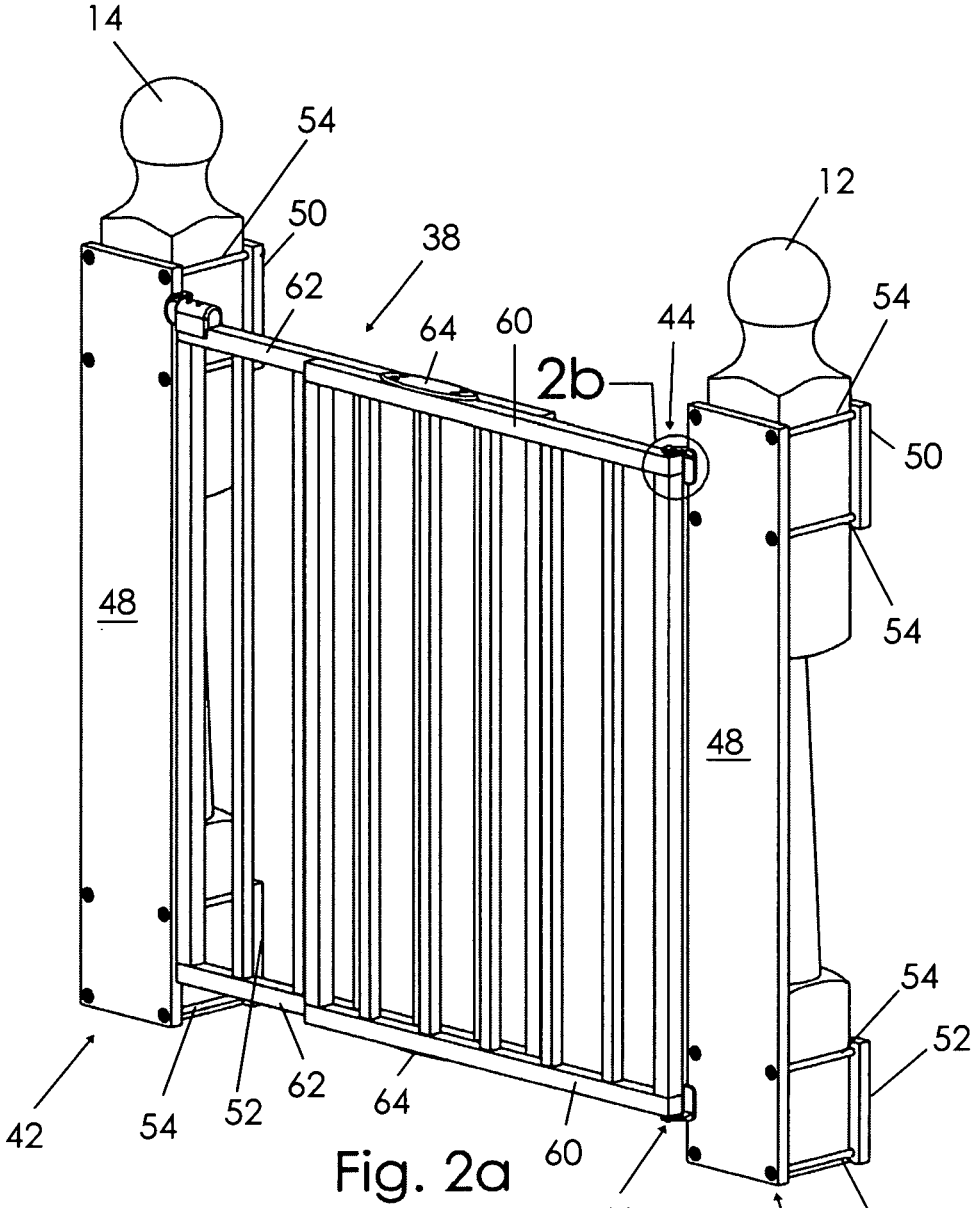
FIG. 2*a* is a perspective view of the gate assembly constructed in accordance with a preferred embodiment of the present invention.
Figure 2B:
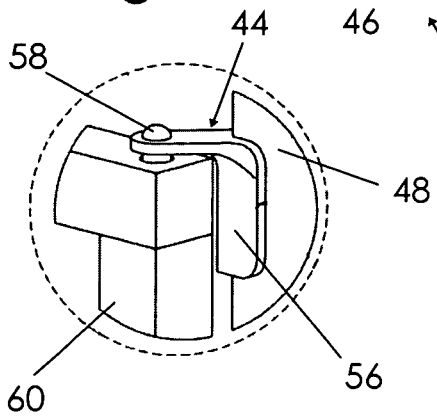
FIG. 2*b* is a perspective view of a hinge of the gate assembly of FIG. 2*a;*

Turning now to FIG. 2*a*, a preferred embodiment of a passageway gate assembly 36 is shown. The gate assembly 36 includes an adjustable gate 38, first and second mounting assemblies 40, 42 and a pair of hinges 44, 46 for coupling the gate 38 to the first mounting assembly 40.

Each mounting assembly 40, 42 includes a mount face plate 48, a pair of backing plates 50, 52 and a plurality of fasteners 54 for securing each face plate 48 to the respective backing plates 50, 52 in order to clamp the mounting assemblies 40, 42 to the respective newel posts 12, 14. The mounting assemblies 40, 42 are adjustable for use with newel posts 12, 14 of varying sizes and shapes and provide a relatively secure base for hingedly coupling the gate 38 thereto.

The hinges 44, 46 include a base portion 56 configured to be coupled with a corner of the face plate 48, and a pintle 58. Each pintle 58 is received in a corresponding aperture formed in the gate 38. The pintles 58 are aligned and define a hinge axis about which the gate 38 may be pivoted. The base portion 56 positions the pintle 58 away from the corner of the face plate 48 so that the hinge axis is positioned to permit pivotal movement of the gate through an arc of about 270°, as shown in FIGS. 3*a*-3*f*.

The gate 38 includes a pair of panels 60, 62 coupled by a pair of clamps 64. The clamps permit selective adjustment of the width of the gate 38 so that the gate assembly 36 is adaptable for use with passageways of varying sizes.

Figure 10:
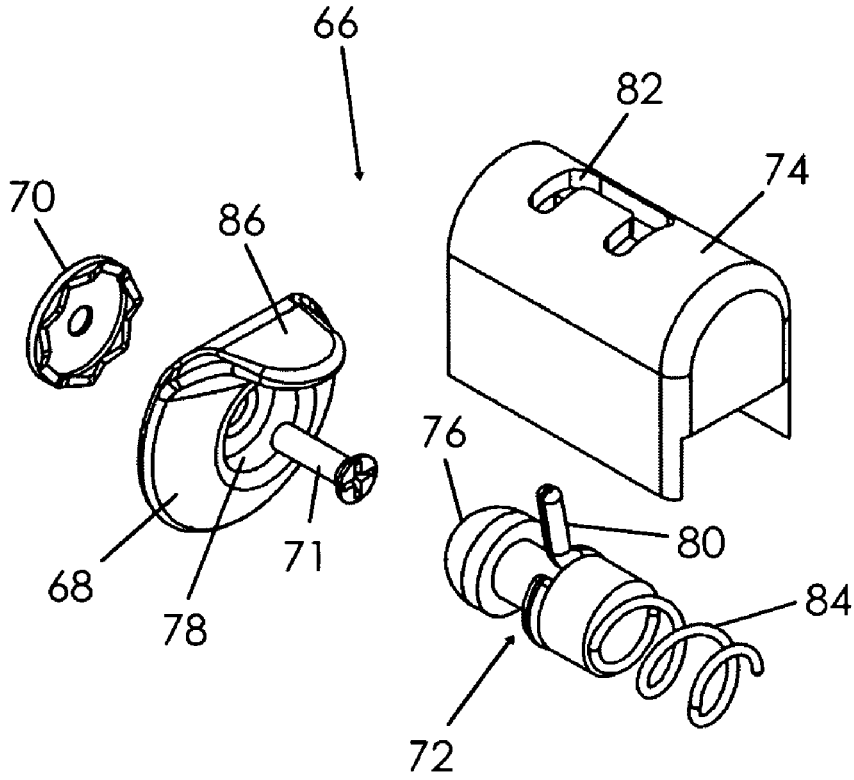
FIG. 10 is an exploded view of the latch assembly.

A unique latch assembly 66 is provided to latch the gate 38 in the closed position, for selectively and securely closing the passageway. As shown in FIG. 10, the latch assembly 38 includes a receptacle 68 having a base 70. The base 70 includes a sawtooth edge and is affixed to the second mounting assembly 42. The receptacle 68 presents a corresponding sawtooth edge (not shown) for engaging the sawtooth edge of the base 70 and preventing rotation of the receptacle 70. The receptacle 70 is attached to the face plate 48 of the second mounting assembly 42 by a fastener 71.

The latch assembly 66 also includes a plunger 72 positioned within a plunger housing 74. The plunger 72 includes a distal end 76 sized for receipt in a receptacle aperture 78, and a guide arm 80 extending radially from the plunger 72. The guide arm 80 is positioned in a generally C-shaped channel 82 formed in the plunger housing 74. The guide arm 80 and channel 82 cooperably control movement of the plunger 72 in the housing 74 between an extended position for engaging the receptacle, and a retracted position. A spring 84 is positioned within the housing 74 as a means of biasing the plunger 72 toward the extended position.

Figure 8A:
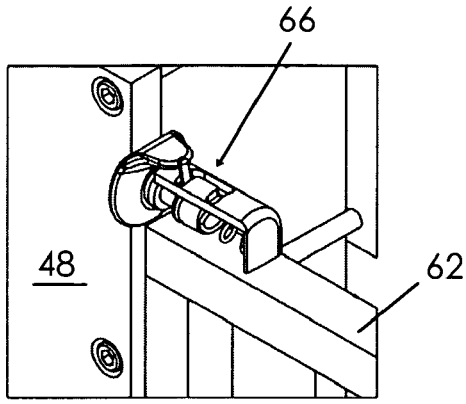
FIG. 8*a* is a perspective view of the latch assembly of the preferred gate assembly.
Figure 8B:
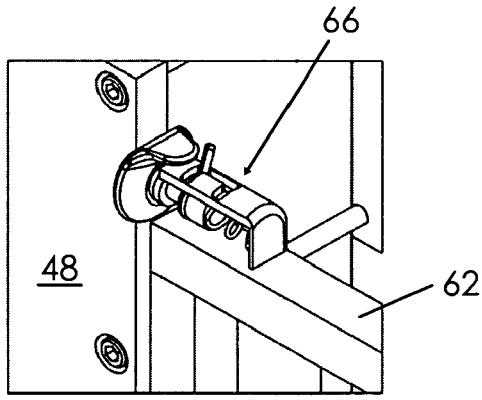
FIG. 8*b* is a perspective view of latch assembly during the disengagement process.
Figure 8C:
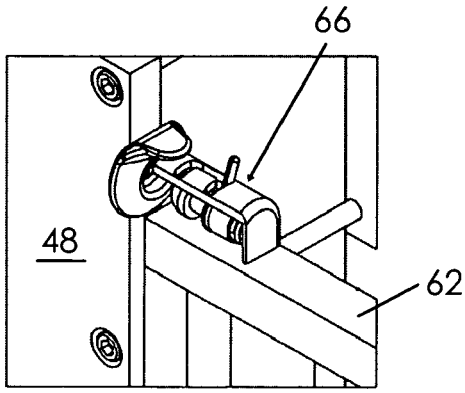
FIG. 8*c* is a perspective view of the latch assembly showing the plunger in a retracted position.
Figure 8D:
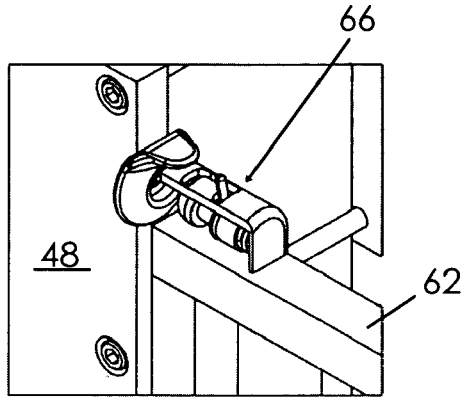
FIG. 8*d* is a perspective view of the latch assembly showing the plunger locked in the retracted position.

Turning now to FIGS. 8*a*-*d*, the latch assembly 66 is depicted in various stages of use. For example, in FIG. 8*a*, the plunger 72 is shown in the extended position where the distal end 76 is received in the receptacle aperture 78, latching the gate 38 in the closed position. Manipulation of the guide arm 80, as shown in FIGS. 8*b*, 8*c*, permits a user to move the plunger 72 to the retracted position where the distal end 76 disengages the receptacle aperture 78 (shown in FIG. 8*d*), permitting pivotal movement of the gate 38.

By including the spring 84, the chance of accidental disengagement of the plunger 72 and receptacle 68 is reduced. It will be appreciated that if the guide arm 80 is accidentally dislodged from a locking position (shown in FIG. 8*a*), the spring 84 prevents the plunger 72 from disengaging the receptacle 68. In addition, while a youngster may be able to learn how to manipulate the guide arm 80, the youngster would not be able to overcome the biasing force of the spring 84 to unlatch the latch assembly and undesirously open the gate 38.

Figure 9A:
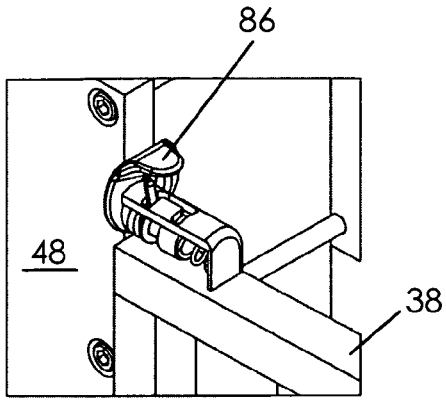
FIG. 9*a* is a perspective view of the latch assembly showing the plunger locked in an extended position.
Figure 9B:
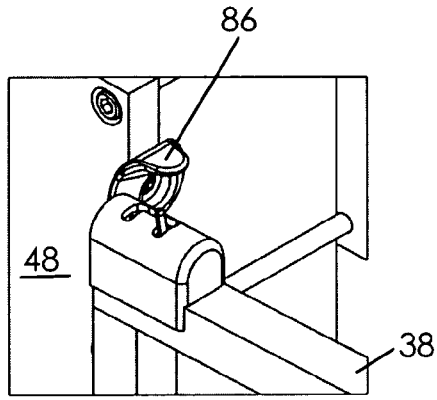
FIG. 9*b* is a perspective view of the latch assembly showing the plunger locked in the retracted position and the gate in a partially open position.
Figure 9C:
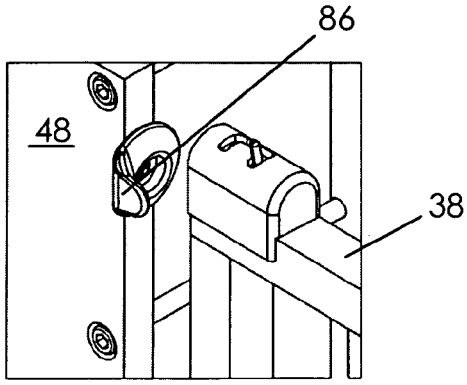
FIG. 9*c* is a perspective view of the latch assembly showing the receptacle configured to prevent pivotal movement in a first direction.
Figure 9D:
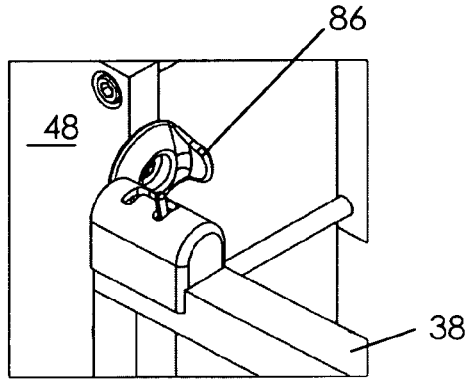
FIG. 9*d* is a perspective view of the latch assembly showing the receptacle configured to prevent pivotal movement of the gate in a second direction.

The receptacle 68 additionally includes an upturned flange 86. While being installed on the second mounting assembly 42, the receptacle may be rotated so that the flange 86 is up or down, or on one side or the other. FIGS. 9*a-d* illustrate how the flange 86 may be utilized to customize the gate assembly 36 during installation. For example, in FIGS. 9*c* and 9*d*, the flange 86 is shown turned to one side. This prevents pivotal movement of the gate 38 beyond the mounting assembly 42, thereby restricting the arc through which the gate 38 may pivot. This may be desirable when the gate assembly 36 is positioned at the top of a stair case to restrict the movement of a youngster and the user does not want the gate 38 to swing out over the stairs. However, when the gate assembly 36 is meant to restrict the movement of a pet that would be unlikely to push the gate 38 out over the stairs, the flange 86 may be set as shown in FIGS. 9*a* and 8 permitting full pivoting of the gate 38 about the hinge axis.

Figure 3A:
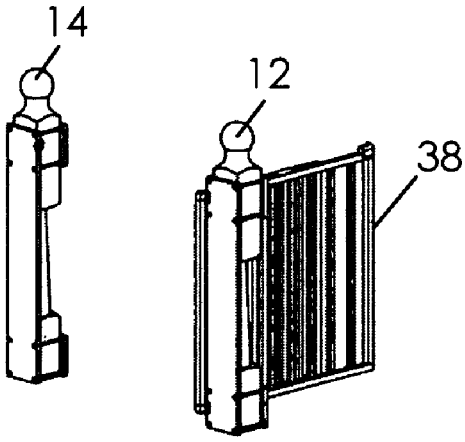
FIG. 3*a* is a perspective view of the gate assembly of FIG. 2*a* showing the gate in a first open position.
Figure 3B:
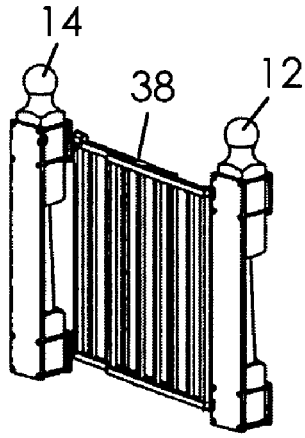
FIG. 3*b* is a perspective view of the gate assembly of FIG. 2*a* showing the gate in a partially open position.
Figure 3C:
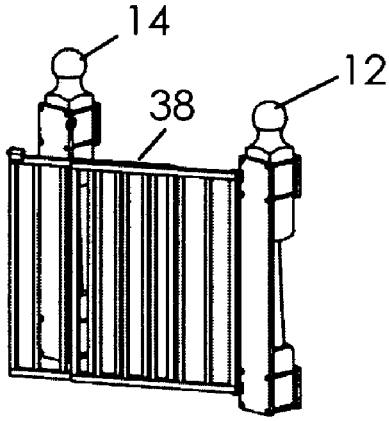
FIG. 3*c* is a perspective view of the gate assembly of FIG. 2*a* showing the gate in another partially open position.
Figure 3D:
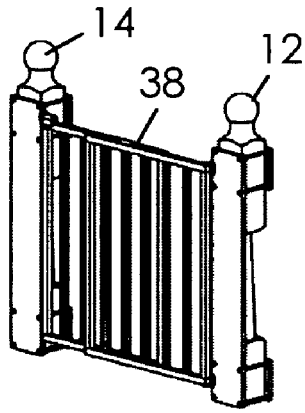
FIG. 3*d* is a perspective view of the gate assembly of FIG. 2*a* showing the gate in a closed position.
Figure 3E:
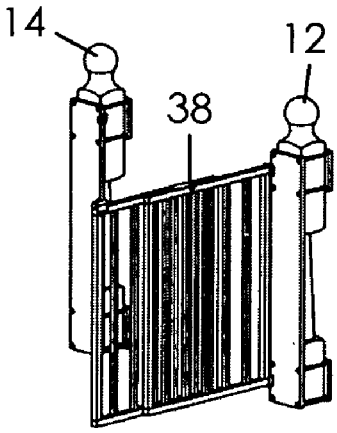
FIG. 3*e* is a perspective view of the gate assembly of FIG. 2*a* showing the gate in another partially open position.
Figure 3F:
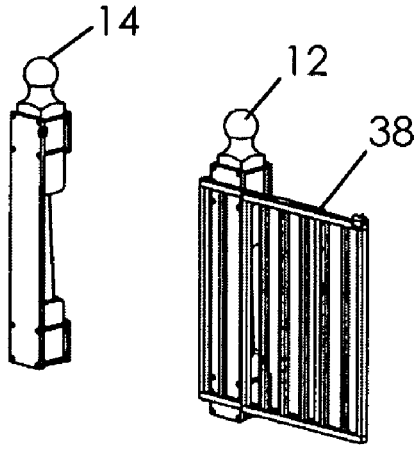
FIG. 3*f* is a perspective view of the gate assembly of FIG. 2*a* showing the gate in a second open position.

Turning now to FIGS. 3*a*-3*f*, the gate assembly 36 is depicted pivoting through its full 270° range of motion. FIG. 3*a* shows the gate 38 in a first fully open position, while FIGS. 3*b*, 3*c* and 3*e* show the gate 38 in partially open positions. FIG. 3*d* shows the gate 38 in a closed position and FIG. 3*f* shows the gate in a second, fully open position.

Figure 4A:
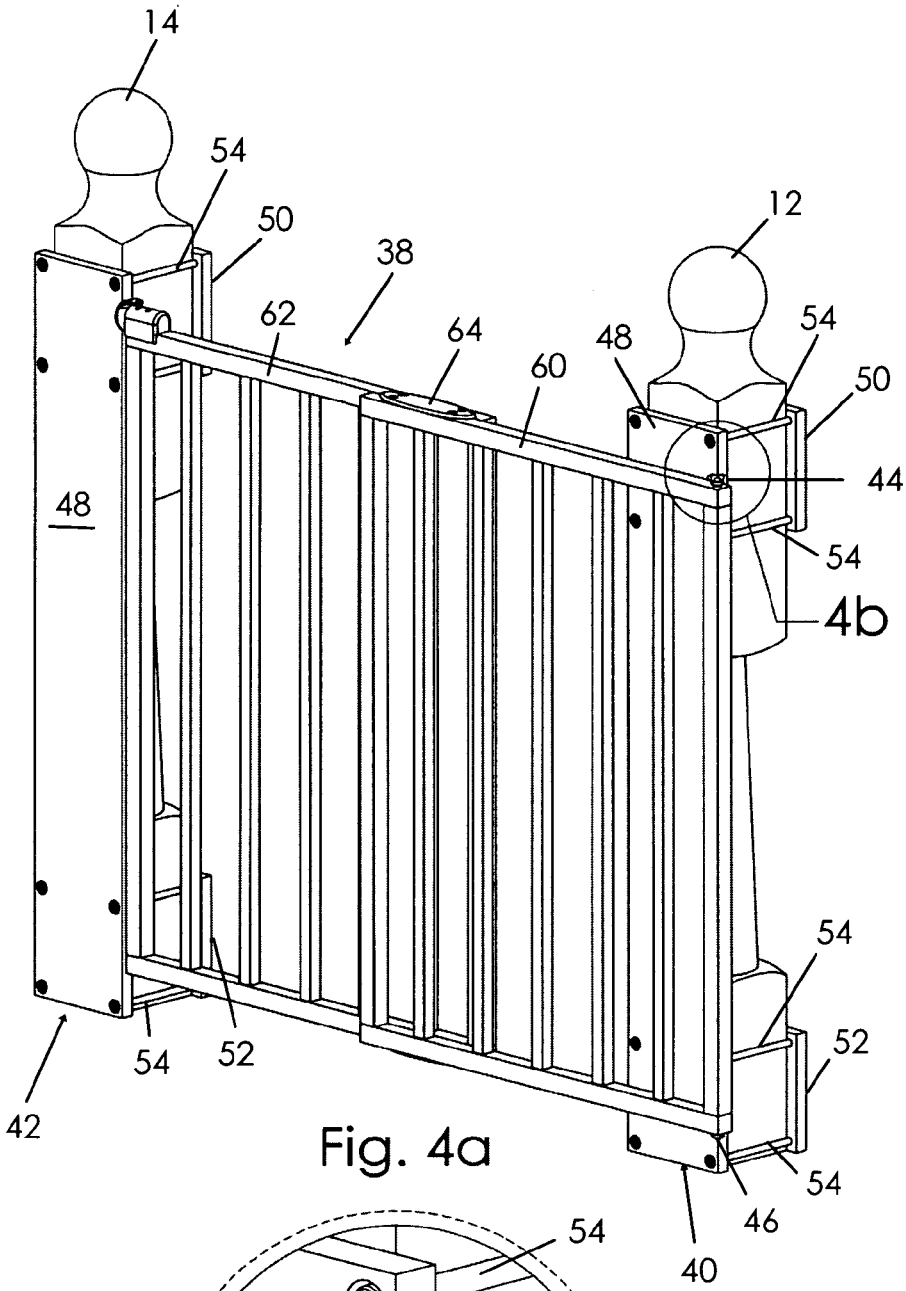
FIG. 4*a* is a perspective view of the gate assembly of FIG. 2*a* showing the hinges mounted in an alternative position.
Figure 4B:
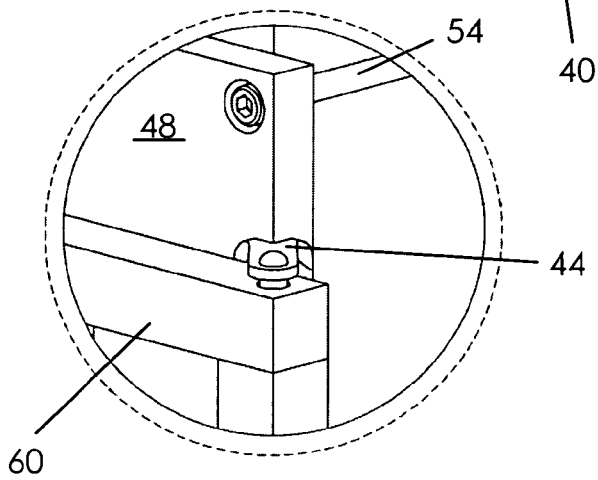
FIG. 4*b* is a perspective view of a hinge of the gate assembly of FIG. 4*a;*
Figure 5A:
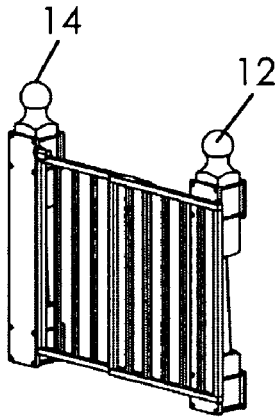
FIG. 5*a* is a perspective view of the gate assembly of FIG. 4*a* showing the gate in a closed position.
Figure 5B:
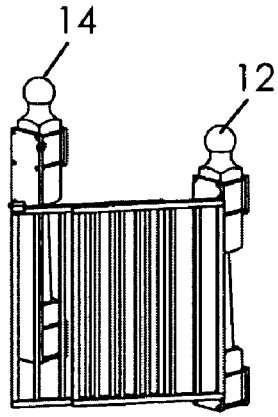
FIG. 5*b* is a perspective view of the gate assembly of FIG. 4*a* showing the gate in a partially open position.
Figure 5C:
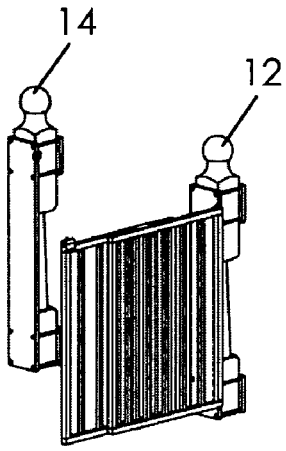
FIG. 5*c* is a perspective view of the gate assembly of FIG. 4*a* showing the gate in another partially open position.
Figure 5D:
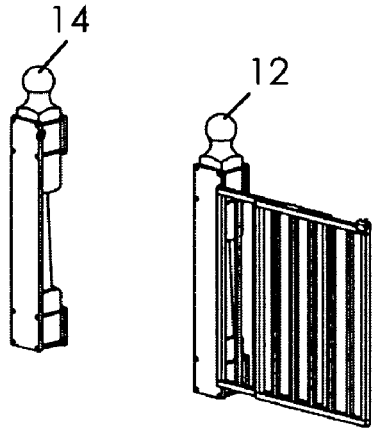
FIG. 5*d* is a perspective view of the gate assembly of FIG. 4*a* showing the gate in another partially open position.
Figure 5E:
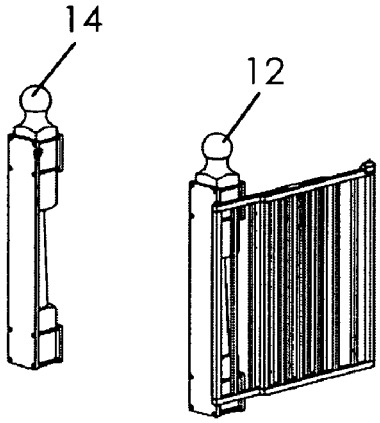
FIG. 5*e* is a perspective view of the gate assembly of FIG. 4*a* showing the gate in a fully open position.

When installing the gate assembly 36, the installer may select a variety of configurations. For example, the configuration shown in FIGS. 2*a*-3*f* is one possibility. An alternative configuration using the same components is shown in FIG. 4*a*. In this configuration, the hinges 44, 46 are positioned along the outer corner of the face plate 48 of the first mounting assembly 40. While this still permits pivotal movement of the gate 38 through an arc of 270°, as shown in FIGS. 5*a-e*, the gate 38 is not able to pivot between the newel posts 12, 14 which may be desirable when the gate assembly 36 is used at the top of a stair case and youngsters are present. This configuration permits pivotal movement of the gate 38 from a closed position, shown in FIG. 5*a*, to a fully open position, shown in FIG. 5*e*. FIGS. 5*b-d* depict the gate 38 in various partially open positions.

Figure 6A:
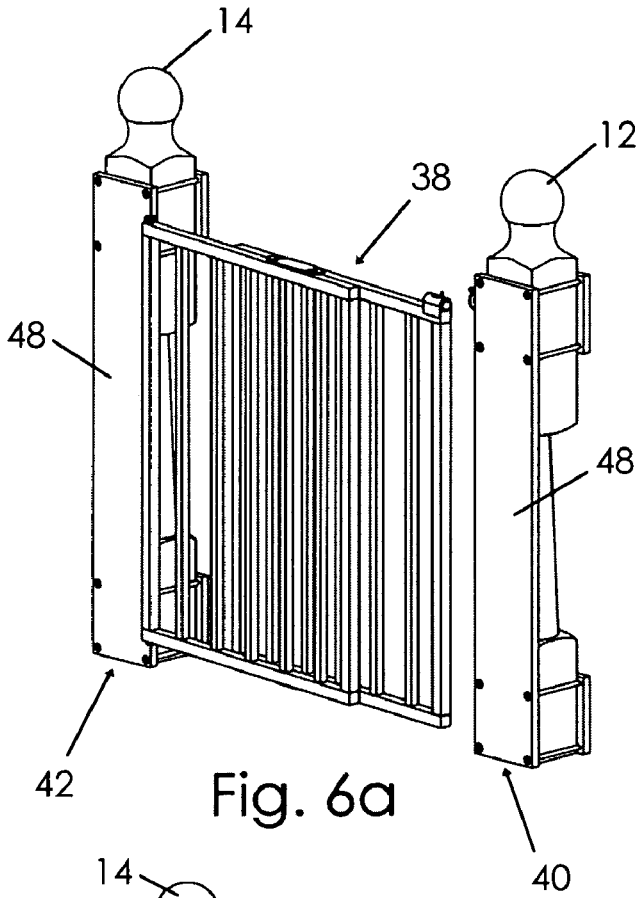
FIG. 6*a* is a perspective view of the preferred gate assembly showing the gate in a partially open position.
Figure 6B:
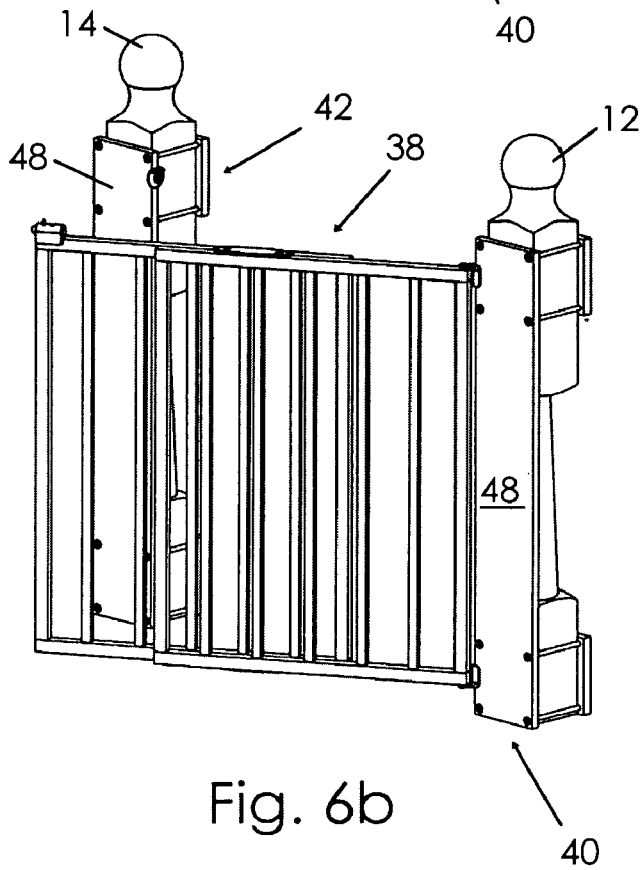
FIG. 6*b* is a perspective view of the preferred gate assembly showing the gate in another partially open position.
Figure 7A:
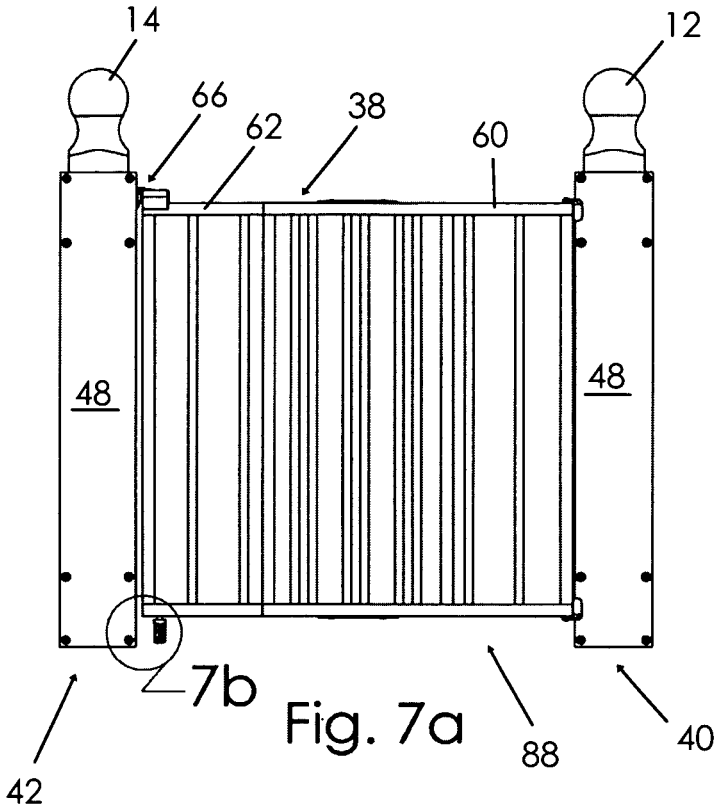
FIG. 7*a* is a front elevation of an alternative embodiment of the gate assembly.
Figure 7B:
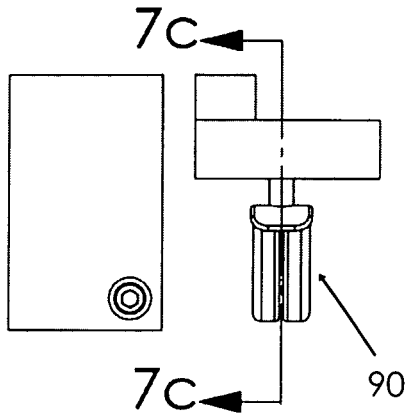
FIG. 7*b* is a front elevation of the wheel assembly of the alternative gate assembly.
Figure 7C:
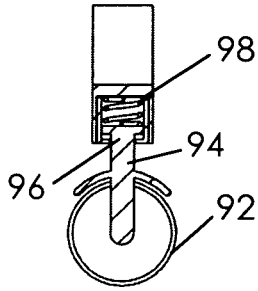
FIG. 7*c* is a view taken along line 7*c* of FIG. 7*b* showing the wheel in an extended position.
Figure 7D:
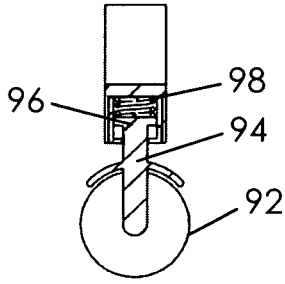
FIG. 7*d* depicts the wheel of FIG. 7*c* in a partially retracted position.

As illustrated in FIG. 6*a*, another configuration of the gate assembly 36 is basically the reverse of the configuration shown in FIGS. 2*a*-3*f*, and FIG. 6*b*. It will be appreciated that the components of the present invention yield a highly adaptable passageway gate assembly that is compatible with many different passageways.

FIGS. 7*a-d* depict an alternative embodiment 88 of the present invention utilizing many of the same components as the preferred gate assembly 36. The gate assembly 88 incorporates a caster wheel assembly 90 coupled with the lower, distal portion of the gate 38. The wheel assembly 90 includes a rotatable wheel 92 and a pivoting strut 94 having a proximal end 96 received in an aperture formed in the gate 38. The strut 94 is movable between an extended position, shown in FIG. 7*c*, and a retracted position, shown in FIG. 7*d*. A spring 98 is provided in the aperture biasing the strut 94 toward the extended position.

In use, the wheel assembly 90 assists in supporting the weight of the gate 38. As a result, torsional forces exerted on the hinges 44, 46 are relatively reduced, extending the operational life of the hinges 44, 46.

Figure 11A:
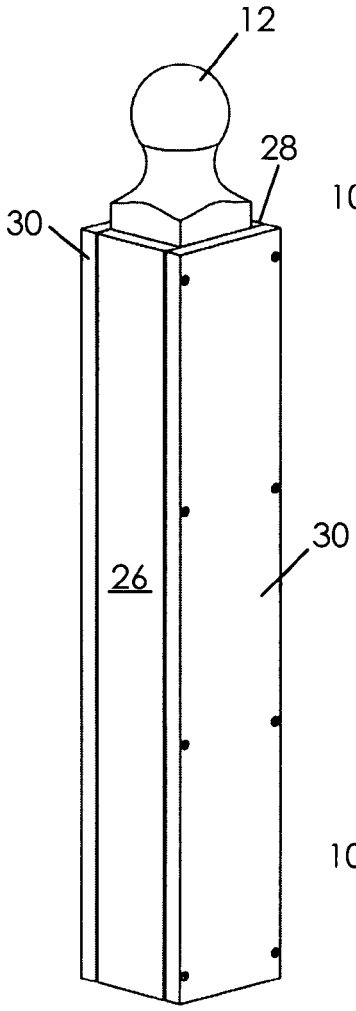
FIG. 11*a* is a perspective view of an embodiment of the mounting assembly.
Figure 11B:
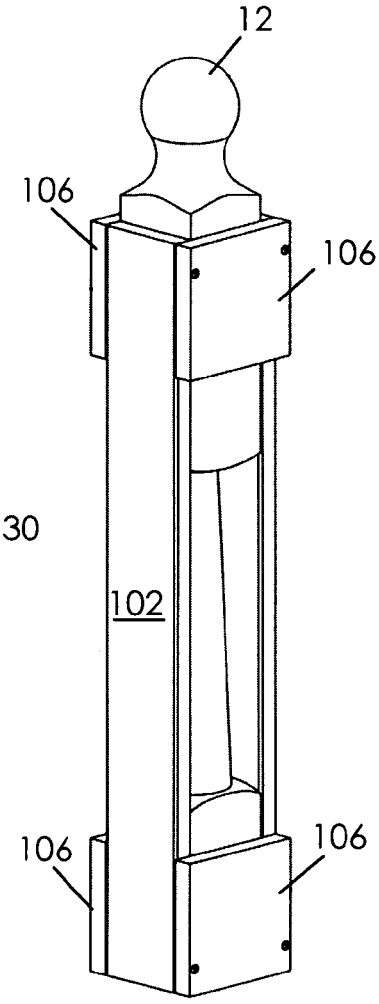
FIG. 11*b* is a perspective view of another embodiment of the mounting assembly.
Figure 11C:
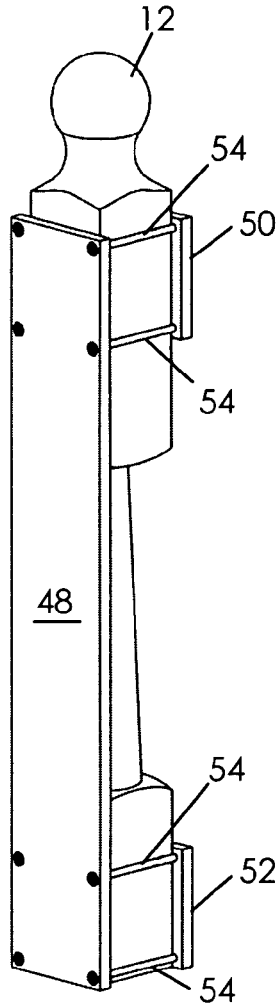
FIG. 11*c* is a perspective view of the preferred embodiment of the mounting assembly.
Figure 12:
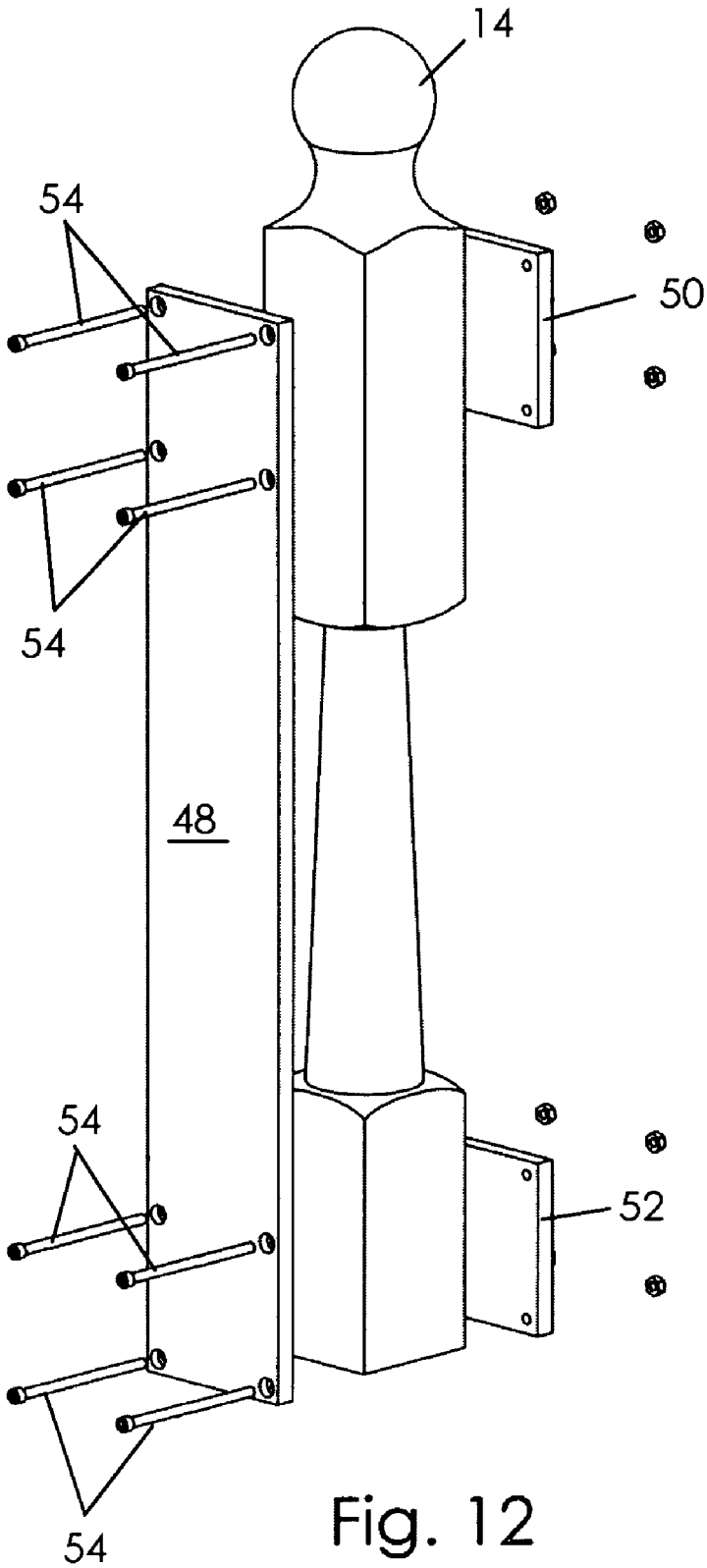
FIG. 12 is an exploded view of the mounting assembly of FIG. 11*c;*
Figure 13A:
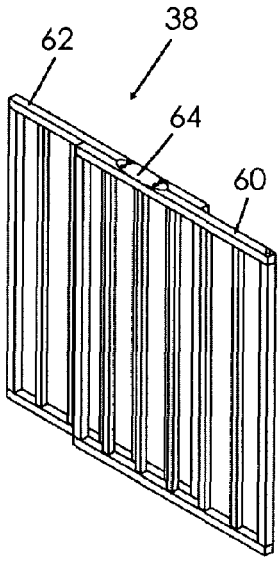
FIG. 13*a* is a perspective view of a preferred adjustable gate.
Figure 13B:
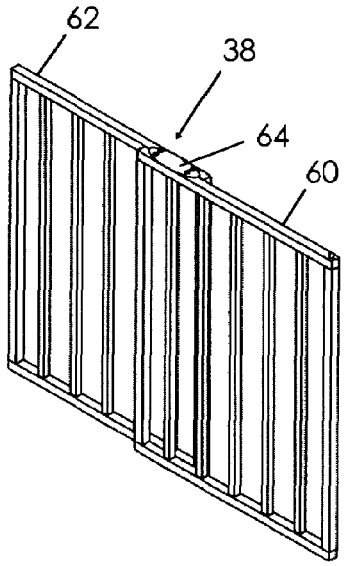
FIG. 13*b* is a perspective view of the gate of FIG. 13 in an extended condition.
Figure 13C:
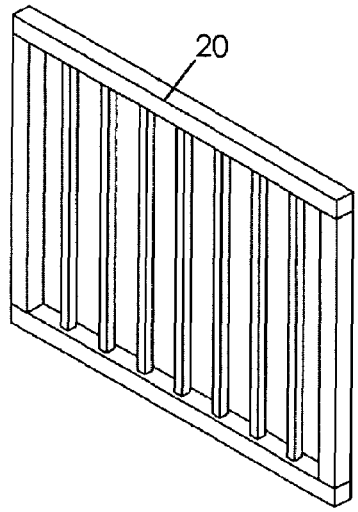
FIG. 13*c* is a perspective view of an alternative gate.
Figure 14:
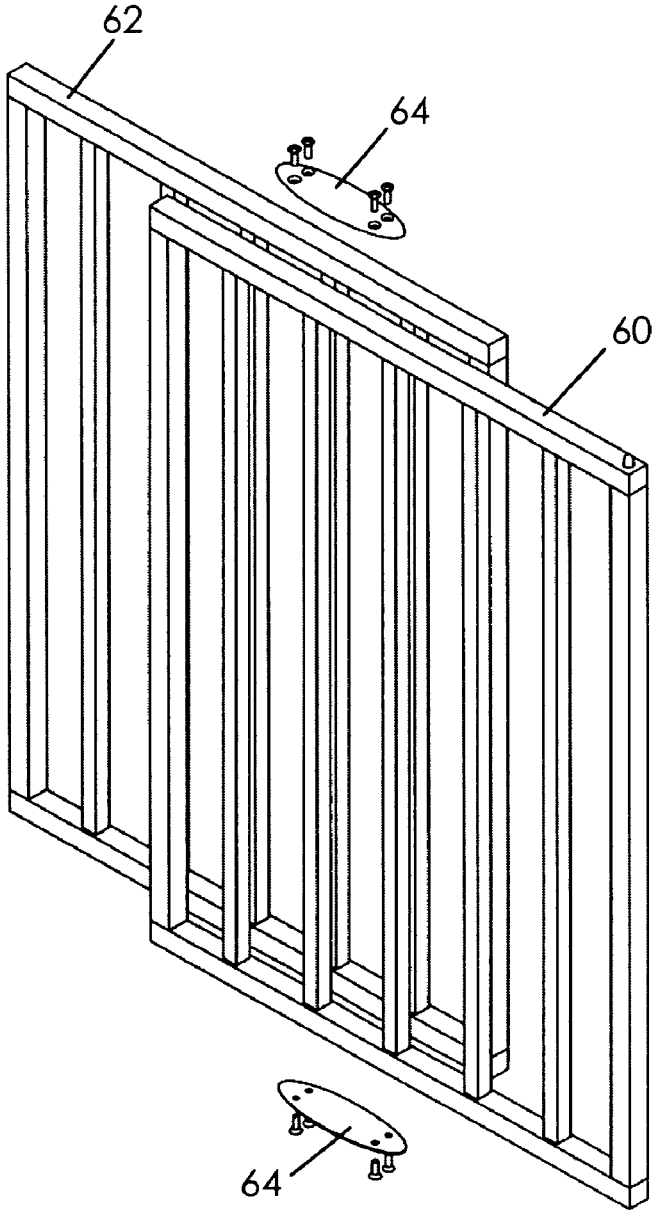
FIG. 14 is an exploded view of the gate of the preferred gate assembly.

FIGS. 11*a-c* illustrate various mounting assemblies. For example, FIG. 11*a* shows the mounting assembly 16, 18 used with the first embodiment 10 of the gate assembly, while FIG. 11*c* shows the mounting assembly 40, 42 used with the preferred embodiment 36 of the gate assembly. An alternative mounting assembly 100 is shown in FIG. 11*b*. The mounting assembly 100 includes a mount face plate 102, a backing plate 104, and a plurality of fasteners 106 for coupling the face plate 102 and the backing plate about the newel post 12, clamping the newel post 12.

It will be appreciated that a gate assembly constructed in accordance with the present invention advances the art of gate assemblies and yields a device that is highly compatible with many different passageways and adaptable for use in many different configurations.

The invention has been described in the above preferred embodiments with reference to the drawing figures. It is understood that substitutions may be made and equivalents employed herein without departing from the scope of the invention as set forth in the following claims.

Having thus described the invention, what is claimed as new and desired to be secured by Letters Patent is as follows:

1. A passageway gate assembly for a passageway having opposed sides, the sides being defined by a first and second newel post, the gate assembly comprising:

a gate;

a first mounting assembly including a mount face plate and a first mounting means for mounting the face plate to one of the first and second newel post;

a hinge defining a hinge axle, the hinge coupling the gate to the face plate and permitting pivotal movement of the gate about the hinge axis between first and second open positions and through a closed position, the gate being substantially parallel to the face plate when in the closed position;

a latch assembly having a plunger with a distal end and a receptacle, the plunger mounted on the gate for movement between an extended position and a retracted position, the receptacle sized for receiving the distal end of the plunger and mounted on the other of the opposed sides of the passageway;

wherein the latch assembly further includes a spring for biasing the plunger toward the extended position;

wherein the latch assembly further includes a plunger housing having a generally C-shaped channel therein and having a guide and extending radially therefrom, the guide arm received through the channel, the guide arm and channel co-operably functioning to lock the plunger into one of the extended or retracted positions;

wherein the gate assembly further includes a second mounting assembly including a second mount face plate and a second mounting means for mounting the second face plate to another one of the first and second newel post; and a flange coupled to the second mounting assembly which moves between at least one position restricting pivotal movement of the gate and another position permitting full pivotal movement of the gate.

2. The passageway gate assembly as set forth in claim 1, wherein the hinge permits pivotal movement of the gate through an arc greater than 180°.

3. The passageway gate assembly as set forth in claim 1, wherein the first mounting means includes a backing plate.

4. The passageway gate assembly as set forth in claim 3, wherein the first mounting means further includes a plurality of fasteners coupling the backing plate and the face plate, and clamping the backing plate and face plate to the one of the first and second newel post.

5. The passageway gate assembly as set forth in claim 1, wherein the gate presents a bottom and further includes a wheel assembly attached to the bottom of the gate, the wheel assembly including a caster wheel.

* * * * *